US006582255B2

(12) United States Patent
Simmons et al.

(10) Patent No.: US 6,582,255 B2
(45) Date of Patent: Jun. 24, 2003

(54) HIGH-DENSITY PLUG CONNECTOR FOR TWISTED PAIR CABLE

(75) Inventors: Randy G Simmons, Winston-Salem, NC (US); Kevin J Peterson, High Point, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/060,005

(22) Filed: Jan. 29, 2002

(65) Prior Publication Data

US 2002/0146924 A1 Oct. 10, 2002

Related U.S. Application Data

(60) Provisional application No. 60/264,763, filed on Jan. 29, 2001.

(51) Int. Cl.[7] ..... H01R 13/502

(52) U.S. Cl. ..... 439/701; 439/607; 439/941; 439/752.5

(58) Field of Search ..... 439/701, 541.5, 439/607, 941, 752.5

(56) References Cited

U.S. PATENT DOCUMENTS

| | | | | | |
|---|---|---|---|---|---|
| 4,168,876 | A | * | 9/1979 | Balde | 439/499 |
| 5,380,223 | A | | 1/1995 | Marsh et al. | 439/610 |
| 5,460,533 | A | | 10/1995 | Broeksteeg et al. | 439/101 |
| 5,567,168 | A | | 10/1996 | Marsh et al. | 439/181 |
| 5,567,169 | A | | 10/1996 | McCleerey et al. | 439/181 |
| 5,649,829 | A | | 7/1997 | Miller et al. | 439/76.1 |
| 5,761,805 | A | * | 6/1998 | Guyer | 29/883 |
| 6,093,061 | A | * | 7/2000 | Varsik et al. | 439/632 |
| 6,106,338 | A | * | 8/2000 | Wu et al. | 439/541.5 |
| 6,120,332 | A | | 9/2000 | Bertens et al. | 439/701 |
| 6,168,458 | B1 | | 1/2001 | Kraft | 439/488 |

* cited by examiner

*Primary Examiner*—Neil Abrams
*Assistant Examiner*—Phuong K Dinh
(74) *Attorney, Agent, or Firm*—Baker & Daniels

(57) ABSTRACT

A plug and receptacle assembly comprises a plug connector and receptacle connector, for high-density interconnections of data cable. The plug connector is comprised of two hermaphroditic housings which both include two rows of electrical terminals. The contact portions of the terminals are disposed on opposite sides of a front cantilevered section, whereas wire connecting sections extend through the rear of the housings and are adapted to receive the wires in a soldering operation. The housings are positioned in a shielding shell when fully terminated to fully shield the connector assembly.

36 Claims, 13 Drawing Sheets

HIGH-DENSITY PLUG CONNECTOR FOR TWISTED PAIR CABLE

This application claims the benefit of U.S. Provisional Patent Application Ser. No. 60/264,763 filed Jan. 29, 2001, the complete disclosure of which is hereby expressly incorporated by reference.

BACKGROUND OF THE INVENTION

1. Field of the Invention

The invention relates to an electrical connector system for high-density interconnection of data cables and the like, and in particular, to an improved high-density plug electrical connector.

2. Summary of the Prior Art

It is common in building wiring closets where hubs and routers are located for distribution and/or storage of data, to have a plurality of racks and panels with multiple electrical interconnections formed by multiple cables. It is commonplace to have such electrical connections made by connection systems commonly known as modular plugs and jacks, the so-called RJ-45 connection system, or other systems such as the RJ-21. Separate connection systems have traditionally been used, due to the speed of the data, the need to minimize EMI radiation, as well as the need to minimize cross talk between adjacent lines in the same connector.

One electrical connection system useful with data interconnections as described above is shown in U.S. Pat. No. 5,649,829 to Miller et al. This connector system is generally known as the CHAMP system and includes a D-shaped mating face, a plurality of electrical terminals for mating to a like connector, and wire connecting sections including insulation displacement contacts. While this connector system is an industry-wide accepted system for telecommunication connections, its main use is when space is not at a premium.

Another connector system is shown in U.S. Pat. No. 5,380,223 to Marsh et al., which is a shielded connector having a plurality of terminals extending to a rear of the connector, where a contact portion is intended to be soldered to cable conductors. This electrical connector, however, was designed for use with a PCMCIA card and does not contain the required density required for the present application.

The objects of the invention are to improve upon the shortcomings as mentioned above.

SUMMARY OF THE INVENTION

The objects of the invention have been accomplished by providing an electrical connector, comprising an insulative housing body assembly comprised of two bi-partite housing portions. Each housing portion includes first and second rows of terminal receiving cavities, a first row adjacent to a first major surface of each the housing portion, and a second row adjacent to a second major surface of each housing portion. The two housing portions are adaptable for stacking together with the second major surface of each housing portion proximate. A plurality of electrical terminals are included where each terminal includes a front contact portion, an intermediate body section, and a rear wire connecting section, the rear wire connecting section comprising a blade section adapted to receive a wire in soldered connection.

Preferably, the connector portions are hermaphroditic. The housing portions include an upstanding alignment post on one side of the second major surface, and a corresponding alignment aperture on a laterally disposed side, whereby when the hermaphroditic housing portions are stacked one above the other, corresponding alignment posts and apertures assure proper alignment. Preferably, the lateral centerline of the terminal receiving cavities is offset from the centerline between the alignment post and alignment aperture.

The terminal receiving cavities are comprised of a front open channel to receive the front contact portions, and a rear open portion allowing access to the rear wire connecting sections. Each housing portion is comprised of front and rear sections, the front section including the front open channels, and the rear section includes the rear open portions. The terminal receiving cavities further comprise intermediate cavity portions for retaining the terminals. The front and rear housing sections include latching mechanisms to retain the two members together. Preferably, the electrical connector further comprises an outer shielding shell enclosing the housing body assembly. The outer shielding shell is profiled to back up the latching mechanisms preventing the latching mechanisms from coming unlatched.

Also preferably, the rear wire connecting sections of the terminals include an L-shaped conductive member, comprised of the flat blade section and a wall section extending from a side edge thereof. Housing portions include wire alignment recesses positioned forward of said rear wire connecting sections, whereby wire ends may be inserted into the wire alignment recesses, assuring alignment over the wire connecting sections. The electrical connector is arranged for connection to twisted pair cable, with side-by-side terminals in the same row being adapted for connection to a twisted pair of conductors, the terminals being arranged with the L-shaped sections back-to-back with a thin web of material between them to minimize the centerline spacing between pairs.

In yet another embodiment of the invention, an electrical connector, comprises an insulative housing body having at least two cantilevered housing sections extending from a main body portion, the cantilevered housing sections being positioned vertically above one another in a laterally offset manner. Each cantilevered housing section including first and second rows of terminal receiving cavities, a first row adjacent to a outside surface of each housing portion, and a second row adjacent to an inside surface of each housing portion. A plurality of electrical terminals is positioned in the housing body where each terminal includes a front contact portion, an intermediate body section, and a rear wire connecting section.

In the preferred embodiment, the rear wire connecting section comprises a blade section adapted to receive a wire in soldered connection. The rear wire connecting sections of the terminals include an L-shaped conductive member, comprised of the flat blade section and an integral wall section extending from a side edge thereof. Preferably, the housing portions include wire alignment recesses positioned forward of the rear wire connecting sections, whereby wire ends may be inserted into the wire alignment recesses, assuring alignment over the wire connecting sections. The electrical connector is arranged for connection to twisted pair cable, with side-by-side terminals in the same row being adapted for connection to a twisted pair of conductors, the terminals being arranged with the L-shaped sections back-to-back with a thin web of material between them to minimize the centerline spacing between pairs.

In the preferred embodiment of the invention, the insulative housing body is comprised of two housing portions, each housing portion having a cantilevered housing section. Preferably, the housing portions are hermaphroditic. The housing portions include an upstanding alignment post on one side of the second major surface, and a corresponding alignment aperture on a laterally disposed side, whereby when the hermaphroditic housing portions are stacked one above the other, corresponding alignment posts and apertures assure proper lateral offset alignment.

Preferably, the terminal receiving cavities are comprised of a front open channel to receive the front contact portions, and a rear open portion allowing access to the rear wire connecting sections. Each housing portion is comprised of front and rear sections, the front section including the front open channels, and the rear section includes the rear open portions. The terminal receiving cavities further comprise intermediate cavity portions for retaining the terminals.

DETAILED DESCRIPTION OF THE PREFERRED EMBODIMENT

Figure 1:
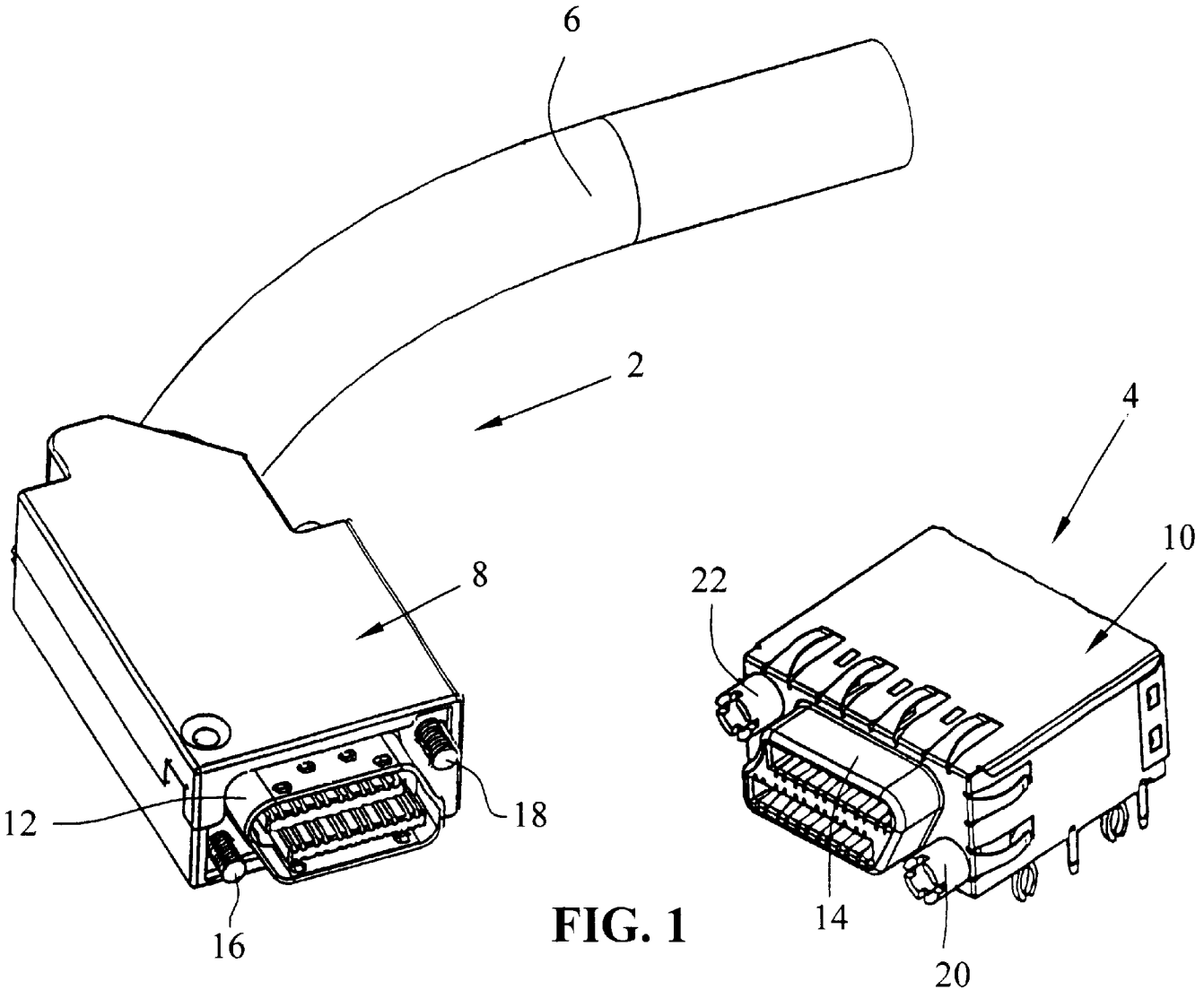
FIG. 1 shows a perspective view showing the plug connector and receptacle connector poised for interconnection.

With respect first to FIG. 1, an electrical interconnection is shown as comprised of a plug connector 2 and a receptacle connector 4. The plug connector 2 is adapted to be connected to a shielded cable 6 which preferably contains a plurality of twisted pair conductors, whereas receptacle 4 is adapted to be connected to a printed circuit board (not shown). Both electrical connectors are fully shielded where the plug connector 2 includes a shielded enclosure 8 which is preferably a die-cast housing of two similar halves, whereas receptacle 4 includes a shield 10 which in the preferred embodiment is a stamped metallic housing.

Each electrical connector also includes a mating interface comprised of a shielding shroud, plug connector 2 having a shielding shroud shown generally at 12 which is profiled to receive in shielding engagement, the shielding shroud 14 of receptacle 4. Finally, plug connector 2 includes elongate jackscrews 16 and 18 which are profiled for threaded engagement with complementary threaded posts 20 and 22, respectively, of the receptacle 4. It should be appreciated that, when the jackscrews 16, 18 are fully threaded into their respective threaded posts 20, 22, the two electrical connectors 2, 4 are in a fully mated condition where electrical terminals within plug connector 2 are fully electrically engaged with electrical terminals in receptacle. While the mating interface of the plug and receptacle connectors will be described in general, this aspect is described even more fully in co-pending patent application filed on even date as Ser. No. 60/264,761 (attorney's docket number 17628), incorporated herein by reference. Furthermore, the receptacle connector 4 is the subject of co-pending patent application filed on even date as Ser. No. 60/264,760 (attorney's docket number 17630), incorporated herein by reference.

Figure 2:
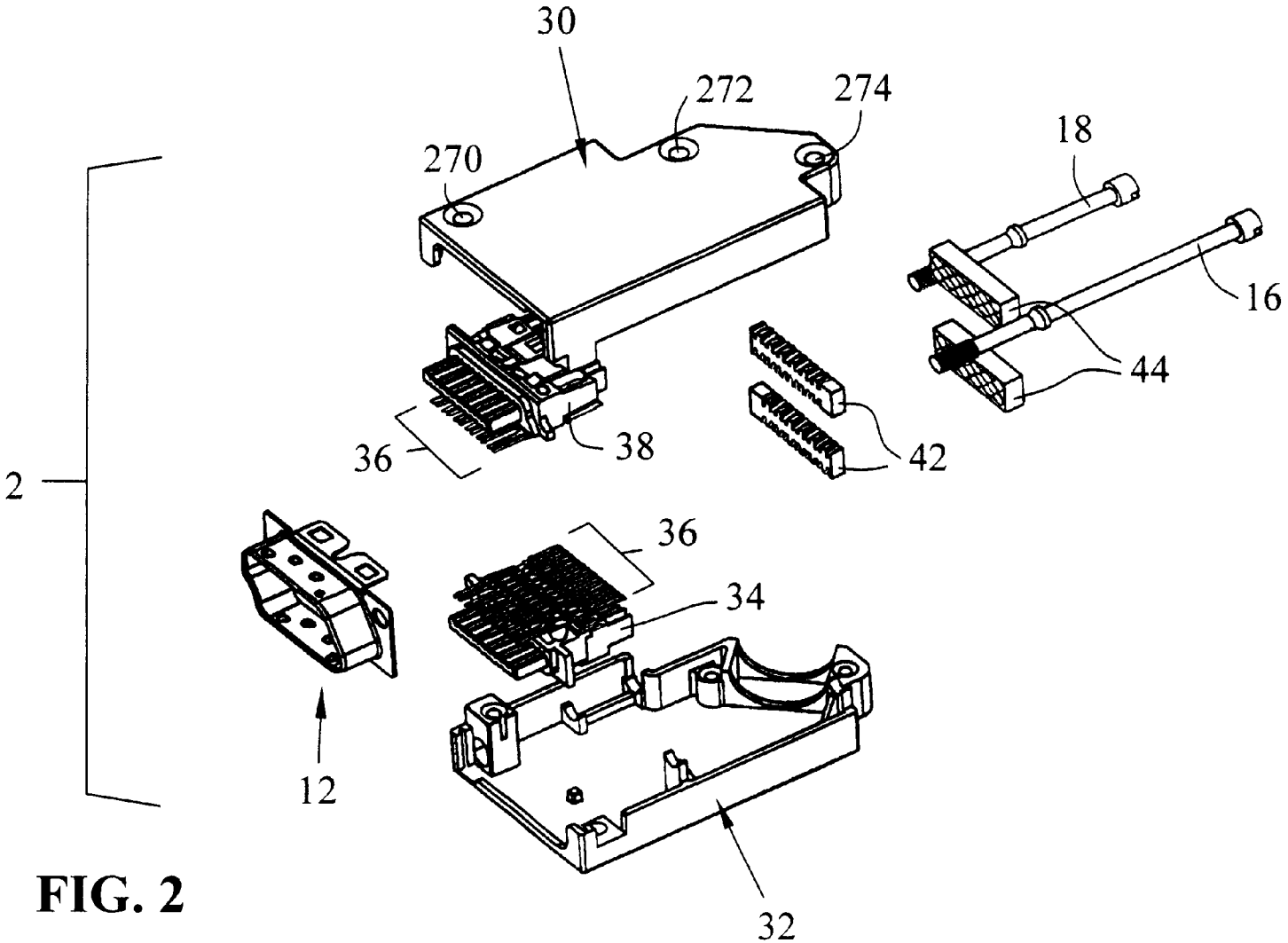
FIG. 2 shows an exploded perspective view of the plug connector of FIG. 1.

With respect now to FIG. 2, the plug connector 2 is shown in an exploded manner for better clarity. It should be appreciated that the shielding shell 8 as shown in FIG. 1 is comprised of bi-partite halves 30 and 32. The plug connector 2 further comprises housing portions 34 and 38 carrying a plurality of electrical terminals 36. The plug connector 2 further includes a pair of wire organizing blocks at 42 to arrange the twisted pairs in alignment with the terminals and a pair of wire dressing blocks 44.

With reference now to FIGS. 3–9, the housing members 34 and 38 will be described in greater detail.

Figure 3:
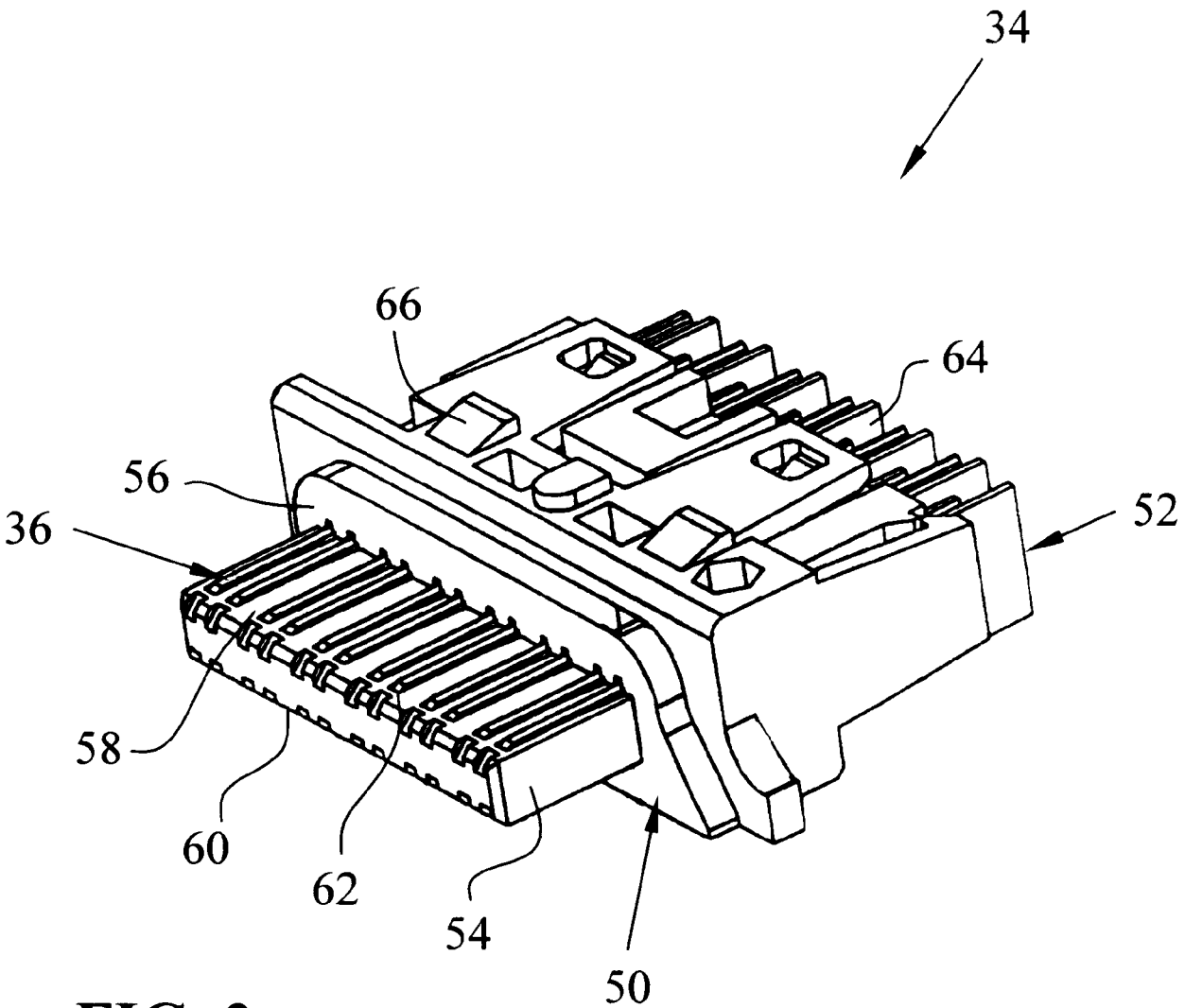
FIG. 3 shows a top front perspective view of one of the 2-piece hermaphroditic housing portions shown in FIG. 2.
Figure 4:
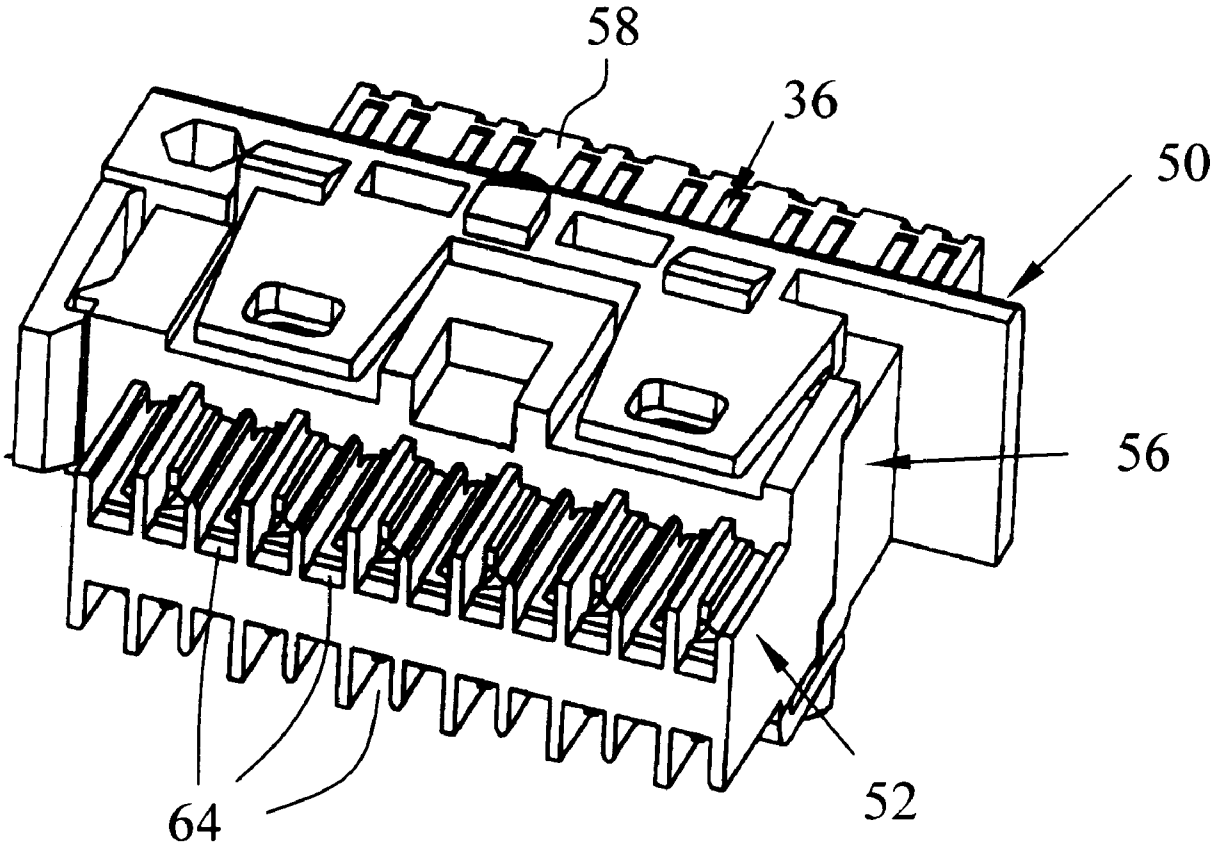
FIG. 4 shows a top rear perspective view of the 2-piece hermaphroditic housing portions shown in FIG. 3.

With reference first to FIG. 3, the housing 34 is shown in greater detail, and it should be understood that housings 34 and 38 are identical and hermaphroditic, thus only one such housing will be described in detail. Housings 34 generally include a front housing portion 50 and a rear housing portion 52. The housing 34 generally includes a front cantilevered section 54 extending from a main body portion 56 of the housing portion. Furthermore, cantilevered section 54 includes a surface 58 and an oppositely directed face at 60, both of which include terminal receiving cavities 62 to receive the plurality of electrical terminals 36. The rear housing portion 52 correspondingly includes a plurality of open-faced wire receiving channels 64 to receive wires in alignment with the terminals 36. The wire receiving channels 64 are best shown in FIG. 4, which is the rear perspective view.

Figure 5:
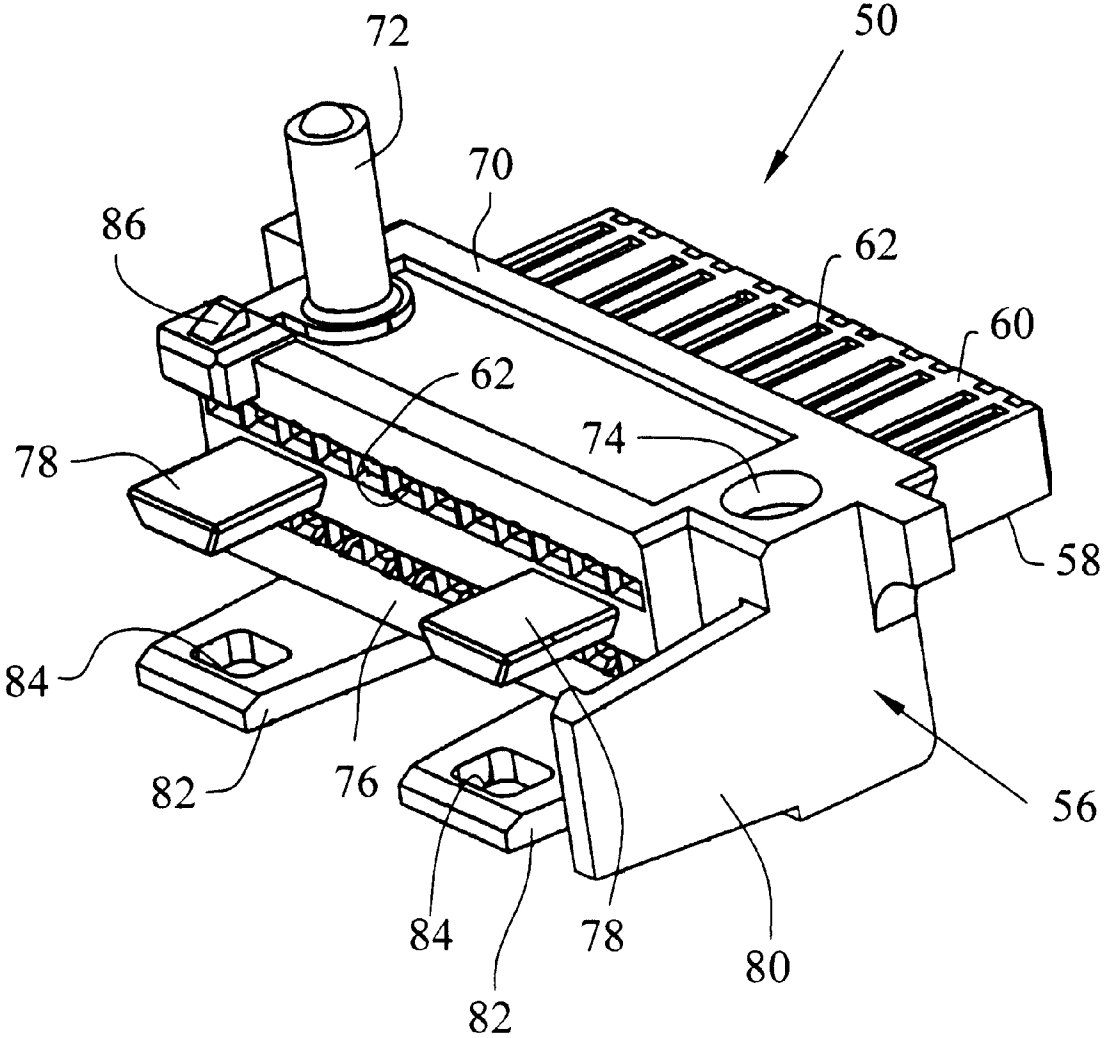
FIG. 5 shows a front portion of the hermaphroditic connector housing shown in FIG. 4.

With respect now to FIG. 5, the front housing portion 50 will be described in greater detail. It should be understood that the view in FIG. 5 is not only from the rear of the connector half, but it also has been flipped around its axial center line, whereby a mounting surface designated at 70 is shown. This surface 70 is an inner surface of the main body portion 56 and includes an upstanding alignment post 72 and a corresponding alignment aperture at 74. The housing 50 also includes a rear face at 76 through which the terminal receiving cavities 62 extend. The rear face 76 also includes alignment bars 78 extending therefrom, which, in the preferred embodiment, are of substantial trapezoidal shape so as to provide a polarizing feature with the rear housing portion 52. The housing portion further comprises a latch arm 80 extending along the side of the main body portion 56, two latch arms 82 having latching openings 84, and finally includes a latch projection at 86.

Figure 7A:
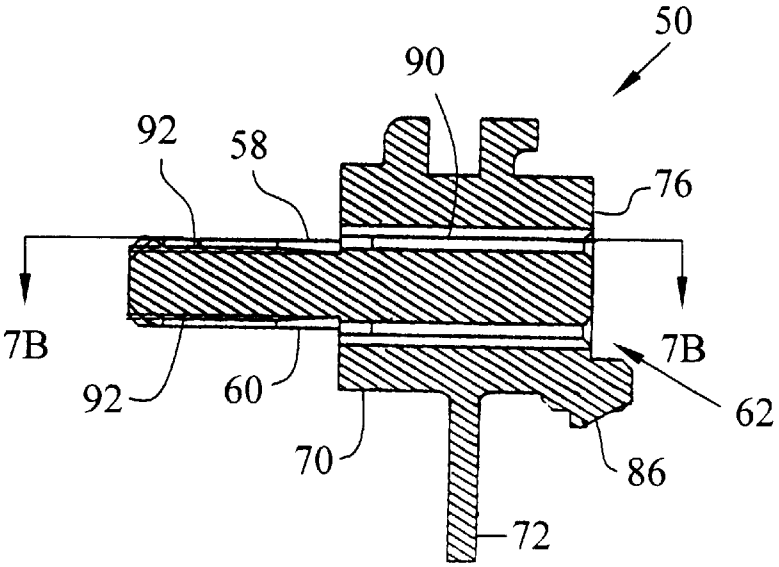
FIG. 7A shows a cross-sectional view through Lines 7A—7A of FIG. 6B.
Figure 7B:
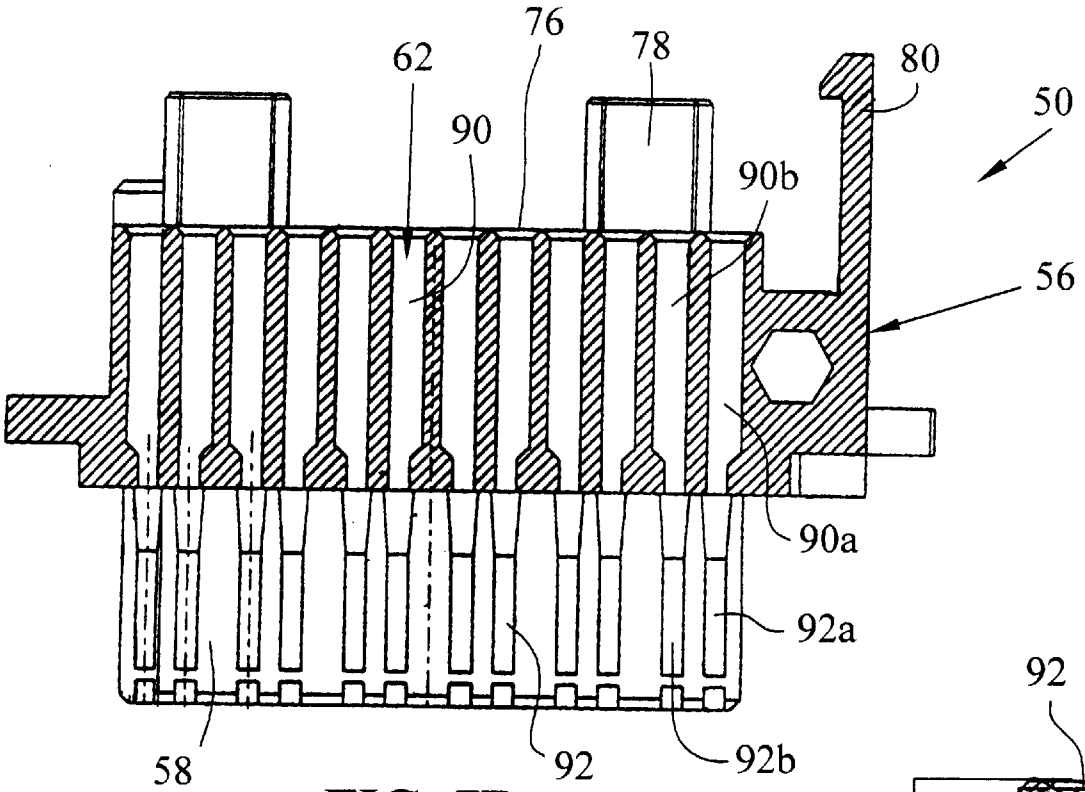
FIG. 7B shows a cross-sectional view through Lines 7B—7B of FIG. 7A.

With reference now to FIG. 7B, the terminal receiving cavities 62 in housing portion 50 include intermediate cavity portions 90 leading into open upper facing channels 92, which actually receive the terminals 36. It should be appreciated that terminal receiving cavities 62 extend in two rows for each housing portion 50, both rows extending through rear face 76 of housing portion 50, where one row opens up onto surface 58, whereas the other row opens onto surface 60.

Figure 8:
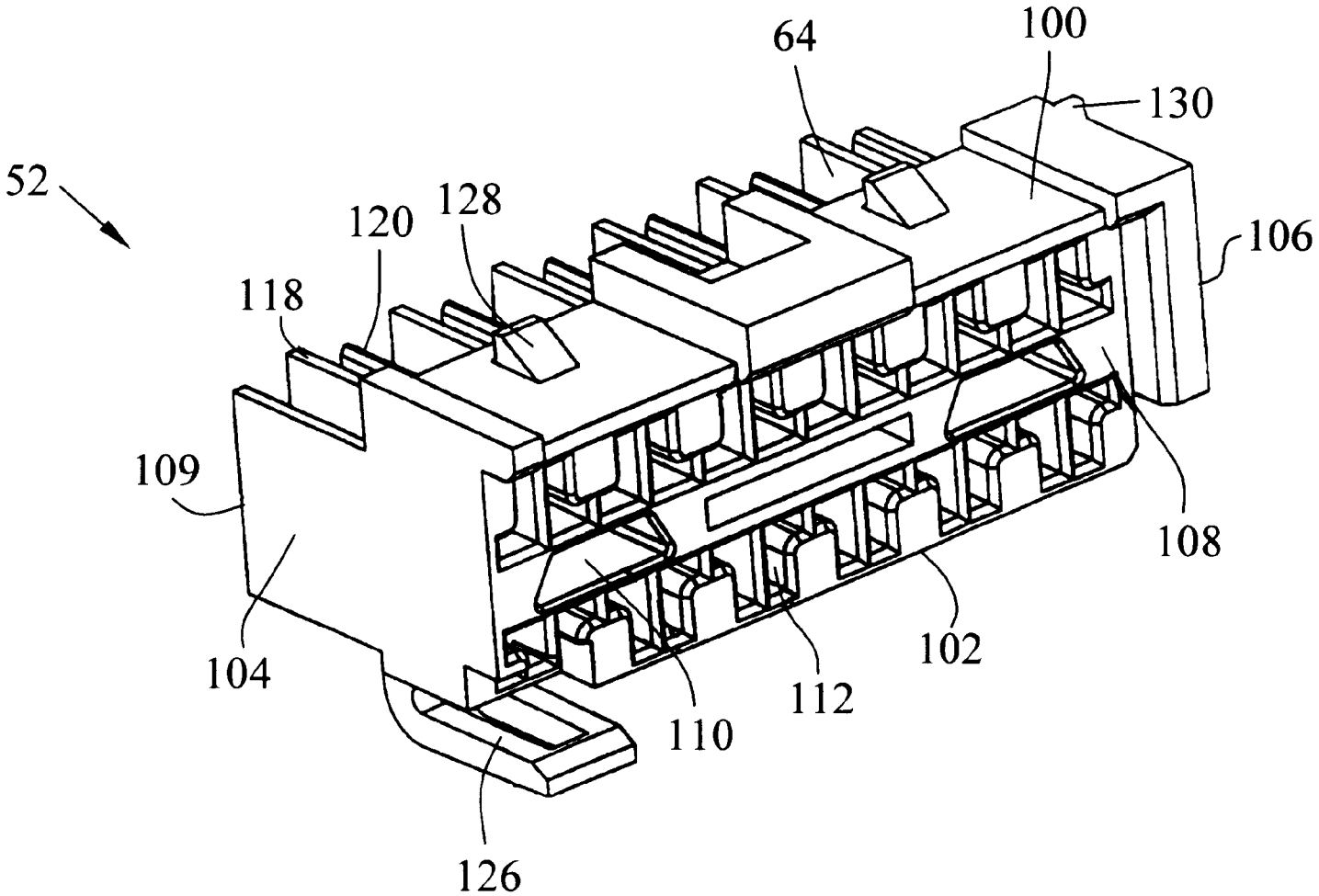
FIG. 8 shows a perspective view of the rear portion of the hermaphroditic connector housing shown in FIG. 4.
Figure 9:
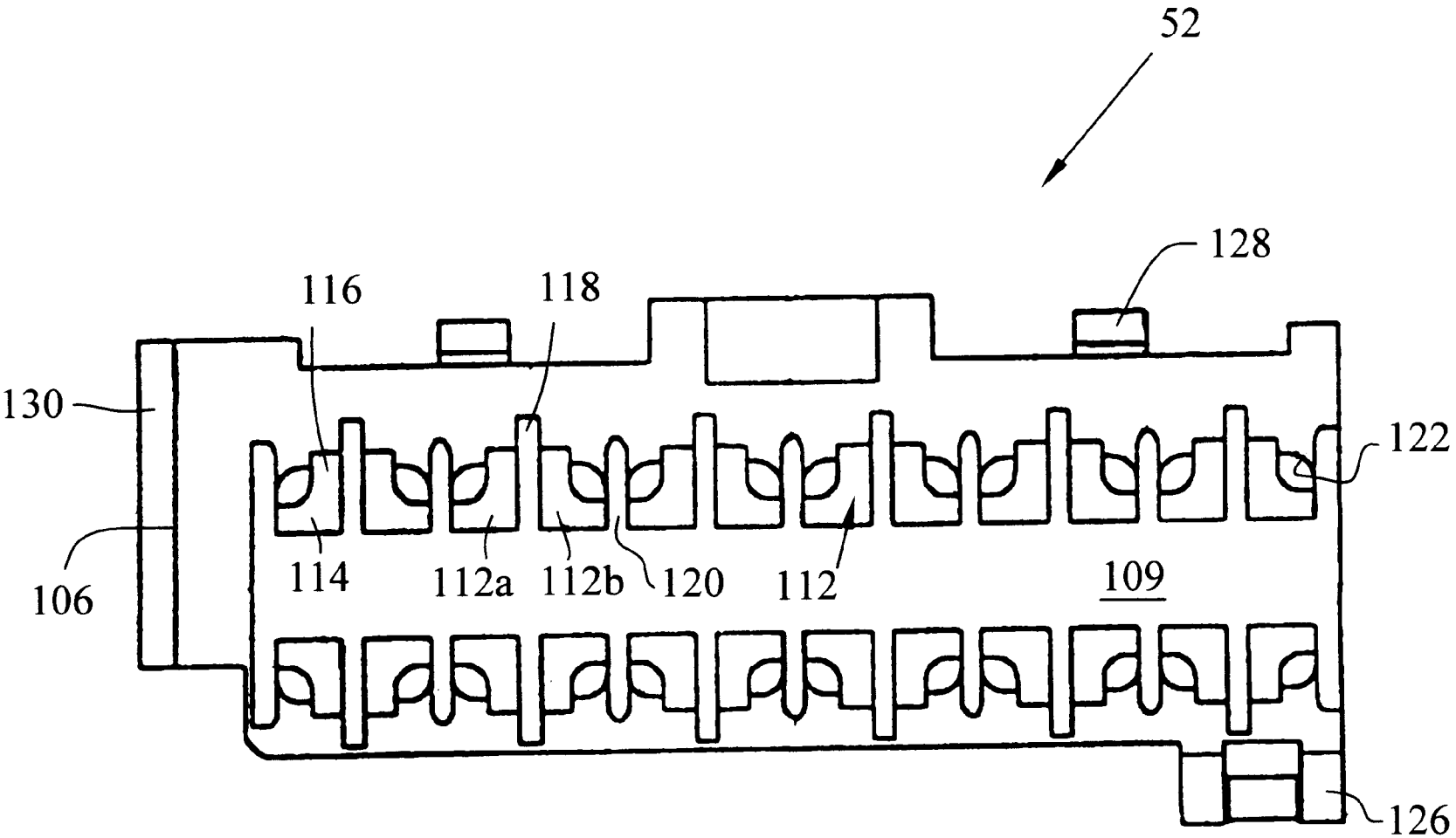
FIG. 9 shows a plan view of the rear portion of the hermaphroditic connector housing shown in FIG. 4.

With respect now to FIG. 8, rear housing portion 52 generally comprises a wall 100, an opposite wall 102, and side walls 104 and 106 extending between leading face 108, and rear face 109. The leading face 108 includes trapezoidal openings at 110 as well as a plurality of rear terminal receiving cavities 112. It should be appreciated that the cavities 112 are arranged in pairs, and are generally L-shaped in configuration. As shown best in FIG. 9, each of the cavities 112 includes a horizontal cavity portion 114 and an upstanding portion 116. It should be appreciated that the pairs are arranged such that upstanding portions 116 are arranged in back-to-back arrangement with a thin web of material 118 disposed therebetween. A further web of material 120 is disposed between adjacent terminals of a different pair. Finally, the cavities 112 include a concave opening 122 facing the L-shaped cavity 112 which will be described herein. Finally, housing portion 52 includes a cantilevered latch arm 126 and latch projections 128 and 130 as described herein.

Figure 10:
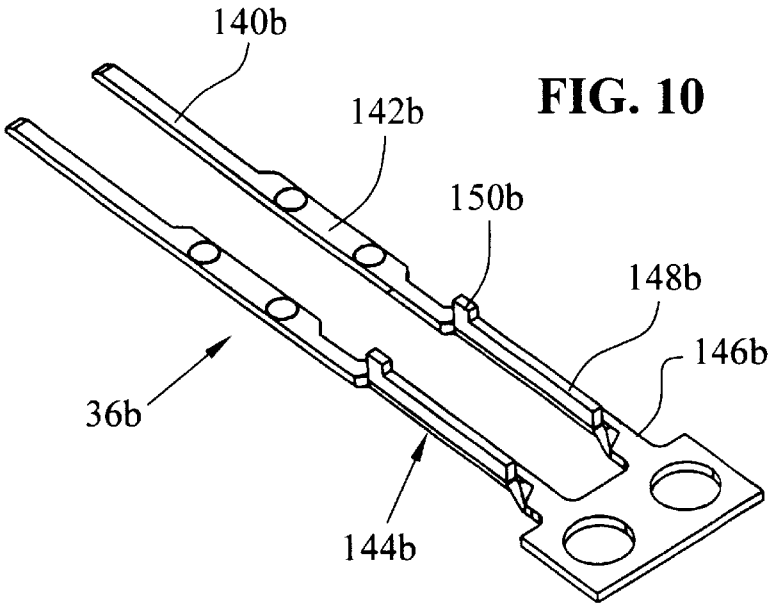
FIG. 10 shows a perspective view of some of the terminals for the connector shown in FIG. 2.
Figure 11:
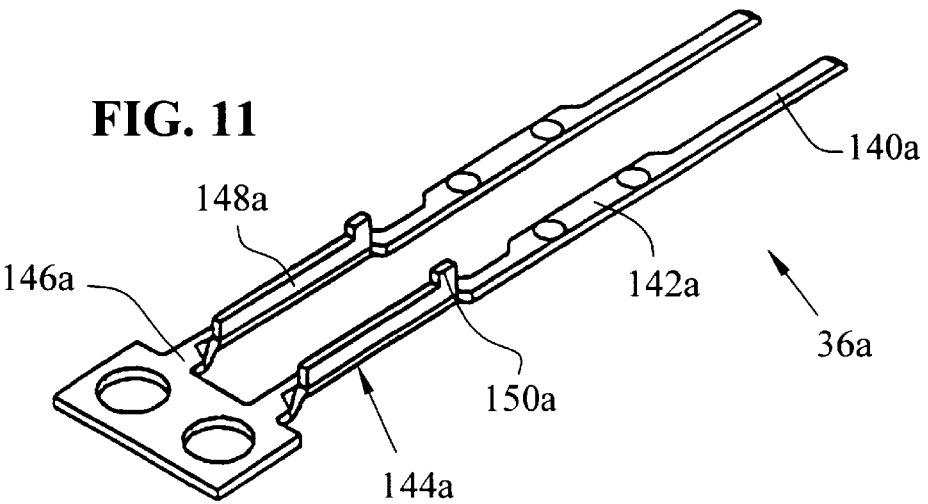
FIG. 11 shows a perspective view of some of the terminals for the connector shown in FIG. 2.

With respect now to FIGS. 10 and 11, the terminals 36 will be described in greater detail. It should be appreciated that the terminals 36, have two different symmetries and therefore have been designated 36A and 36B in FIGS. 10 and 11. Thus, terminals 36A and 36B are profiled to be received in respective cavities 112A and 112B. With respect first to terminal 36A, the terminal includes a front contact portion 140A having a central retaining portion 142A and a wire connecting portion 144A. The wire-connecting portion is comprised of a flat blade portion 146A and an integral upstanding wall portion 148A. The upstanding wall portion 148A includes a retaining stop portion at 150A. In a similar manner, terminal 36B includes front contact portions 140B, central retaining sections 142B, and rear wire connecting sections 144B. Likewise, wire-connecting section 144B includes a flat blade section 146B and an integral upstanding wall portion 148B. Likewise, the upstanding wall portion 148B includes a stop portion at 150B.

Figure 12:
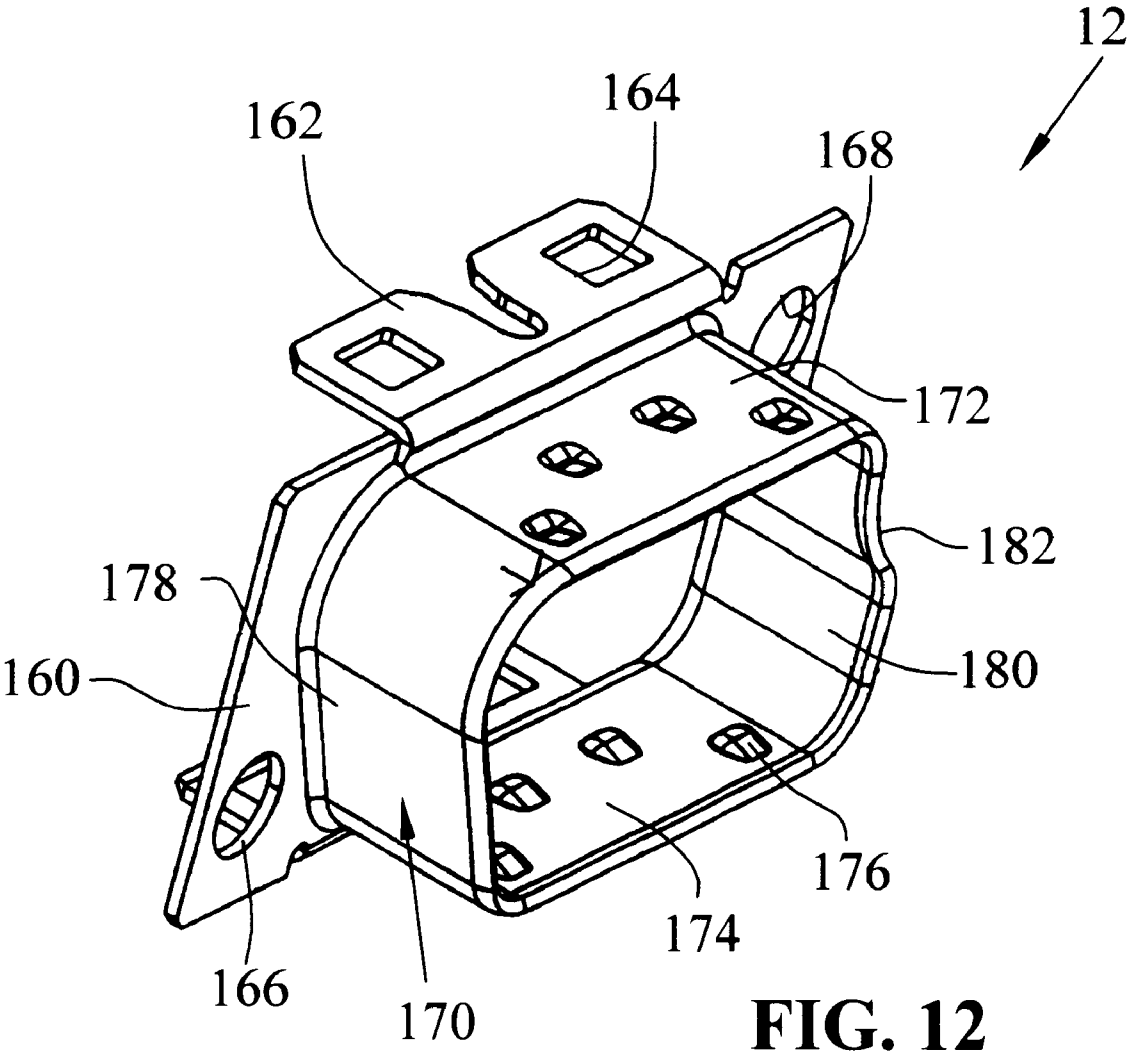
FIG. 12 shows the shield shroud of the plug connector of FIG. 1.

With respect now to FIG. 12, the shielding shroud 12 is shown as including a base wall 160 having latch sections 162 extending therefrom, having latching openings at 164. The base wall 160 further includes diametrically opposed openings at 166, 168. The shroud 12 further includes a peripheral shroud portion 170 which is a drawn shroud portion extending forwardly from the base wall 160. The shroud section 170 includes a top shroud wall 172, a lower shroud wall 174, which is generally disposed parallel to upper wall 172, where each of the walls includes stamped projections at 176 acting as shielding contacts, as is well known in the art. End wall 178 forms an obtuse angle relative to lower wall 174 and an acute angle with respect to 172. On the opposite side of the shroud, a generally vertical upstanding wall portion is shown at 180 (vertical relative to wall 174) which is continuous with a concave radiused portion at 182. It should also be appreciated that apertures 166 and 168 are diametrically opposed in opposite corners of the base wall 160 where aperture 166 is positioned so as to be partially extending beneath wall portion 178, with aperture 168 extending adjacent the concave radiused portion 182. It should be appreciated that the concave radiused portion 182 provides enough room in the corner of the base wall to provide the aperture 168.

Figures 13, 14:
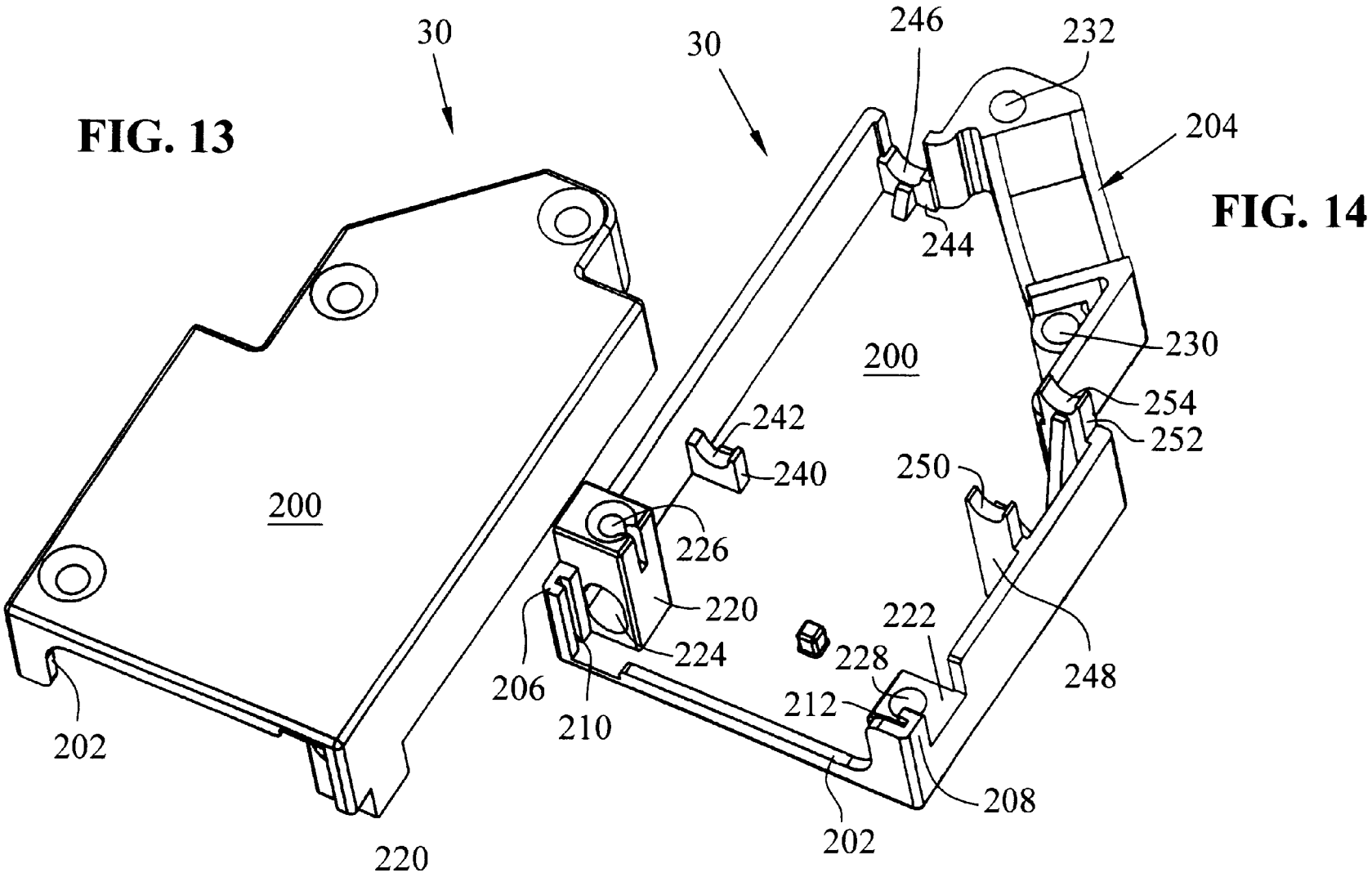
FIG. 13 shows a top view of a first shield shell for the plug connector.
FIG. 14 shows the underside of the shield shell of FIG. 13.

With respect now to FIGS. 13 and 14, the shielding shells 30, 32 will be described in greater detail. It should be appreciated that both FIGS. 13 and 14 depict shielding shell 30, but that shielding shell 32 would be identical, with the exception of the cable entry opening orientation, as will be described. As shown best in FIGS. 13 and 14, shielding shell 30 is comprised of a generally flat wall portion 200 having a front opening portion at 202 and a rear cable-receiving portion at 204. As shown in FIG. 14, the shielding shell 30 includes upstanding wall portions 206, 208 having vertically oriented slots at 60, 62 for placement of the shielding shroud as will be described herein.

As shown in FIG. 14, shielding shell 30 further includes complementary mounting blocks 220, 222 where mounting block 220 includes a horizontally disposed through-hole 224 and a vertically disposed mounting aperture at 226. Meanwhile, mounting block 222 includes a through-hole at 228 which will align with a mounting hole in the opposite shielding shell when the two shielding shells are placed together. The cable-receiving opening at 204 further includes openings at 230 and 232 which will also align with openings in the opposite shielding shell 32 when aligned. Finally, the shielding shell 30 includes a jackscrew support at 240 having a U-shaped section 242, and a support member 244 having a U-shaped section 246. On the opposite side, a jackscrew support is shown at 248 having a U-shaped section at 250, whereas a support 252 has a U-shaped section at 254.

With the plug connector components as described above, the assembly of the plug assembly 2 will be described in greater detail. With reference first to FIG. 2, the terminals 36 will be assembled within connector housing portions 34, 38. It should be appreciated that two rows of terminals 36 will be positioned in housing 34, and two rows of terminals 36 will be positioned in housing 38. This positions an end portion of terminals 36 adjacent a rear portion of their respective housings for soldering to respective conductors of multiconductor cable 6 (FIG. 1). In the preferred embodiment, there are two rows of twelve terminals 36 in housing 34, and two rows of twelve terminals 36 in housing 38, or forty-eight terminals total, which will accommodate 24 twisted pair conductors. It should be appreciated from the description above relative to FIGS. 10 and 11 that a pair of terminals 36A and 36B are positioned in respective cavities 62, such that front contact section 140A of terminal 36A resides in open channel 92A, with central contact portion 142A residing in cavity portion 90A. Likewise, terminal 36B is positioned in the cavity 62 such that front contact portion 140B resides in open channel 92B, with central contact portion 142A residing in cavity portion 90B. It should be appreciated that the contacts are all stitched in, in this fashion, which places the upstanding wall portions 148A, 148B of the terminals 36A, 36B in back-to-back relation throughout the housing. It should also be appreciated that the wire connecting portions 144A, 144B of all contacts still extend from the housing 50 at this point. The rear housing portions 52 are now positioned over the wire connecting portions 144A, 144B; with respective cavity portion 112A, 112B (FIG. 9) slidably received over all wire connecting portions 144A, 144B.

Figure 15:
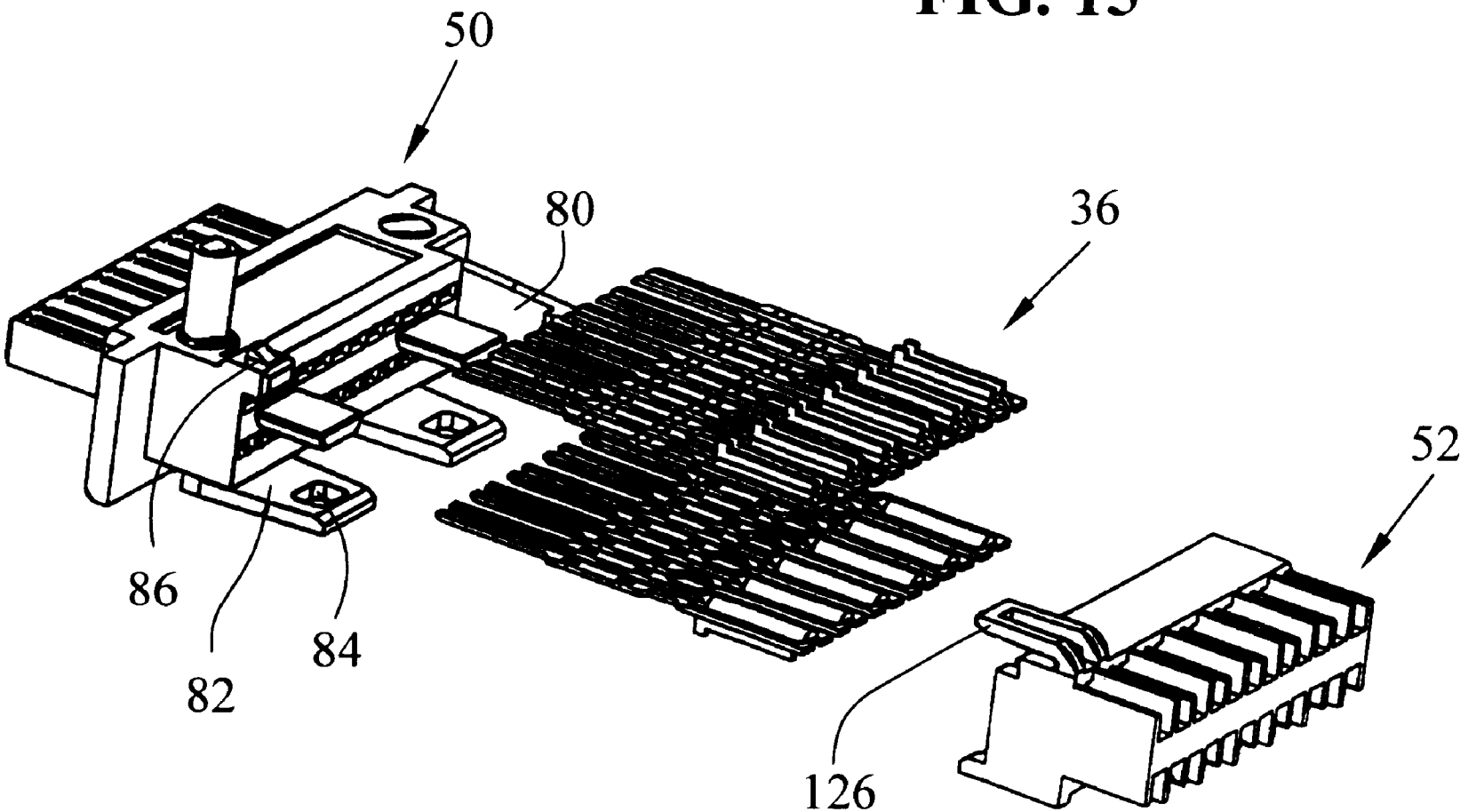
FIG. 15 shows a perspective view showing the terminals poised for receipt in the housing portions.

FIG. 15 shows two rows of terminals 36 poised for receipt within the respective housing 50, with rear housing portion 52, aligned for receipt over the terminal ends, and for snap latching the housing. The rear housing portion is slid forward until the rear housing 52 is latched into position with housing portion 50, that is, latch 126 snaps over corresponding projection 86; latch openings 84 of latch arms 82 snap over corresponding projections 128 (FIG. 8) where latch arm 80 snaps over corresponding projection 130 (FIG. 8). This also traps portions 150A, 150B of terminals 36A, 36B within the housings, against shoulders defined in the respective housings 50, 52. It should be appreciated that this process continues, until two identical housings 34, 38 are completed.

To assemble the conductors to the various terminals 36, the twisted pairs, while still twisted, are inserted through apertures of wire organizing blocks 44 and then the wires are separated and placed in individual slots of the dressing blocks 42. It should be appreciated that housing 34 and 38 are sandwiched together to form a housing assembly, therefore, the inside facing terminals are soldered first, and then the outer row of terminals 36 receive their respective wires. To perform the soldering function, the individual wires of the twisted pair are stripped, such that the length of the exposed conductor is longer than the length of the corresponding wire connecting sections 144A, 144B. The tip end of the conductor is inserted into the opening 122, which by nature of its radiused configuration facing the wire connecting portions, directs the conductor in an organized fashion neatly in the pocket provided by the blade sections 146A, 146B and the wall portions 148A, 148B for soldering.

Figure 6A:
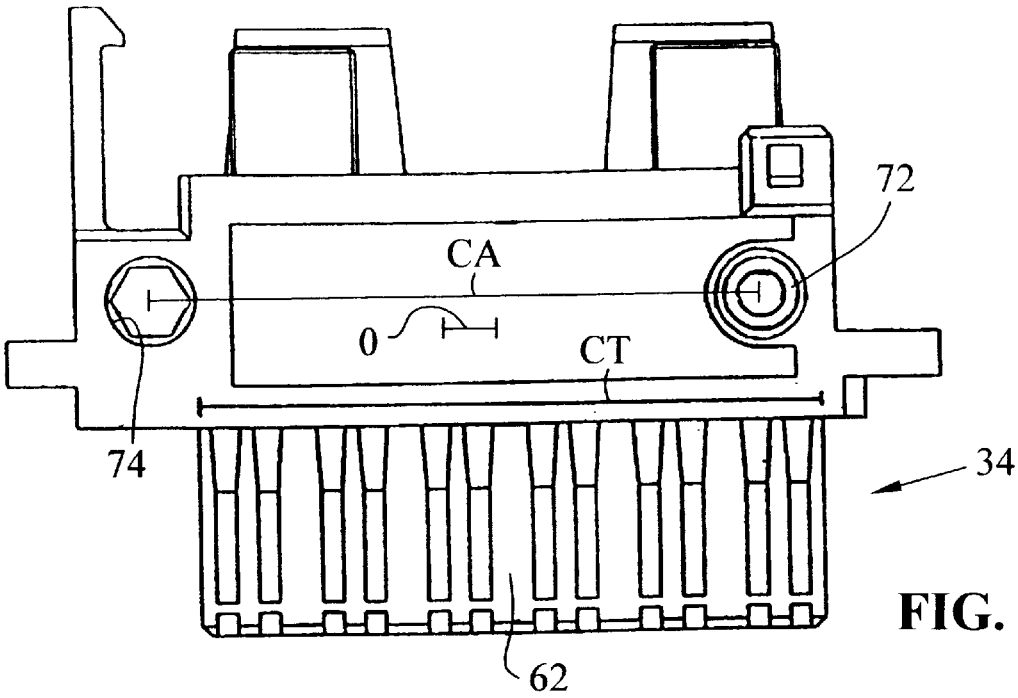
FIG. 6A shows a plan view of the housing from the perspective showing the alignment post and corresponding alignment opening.
Figure 6B:
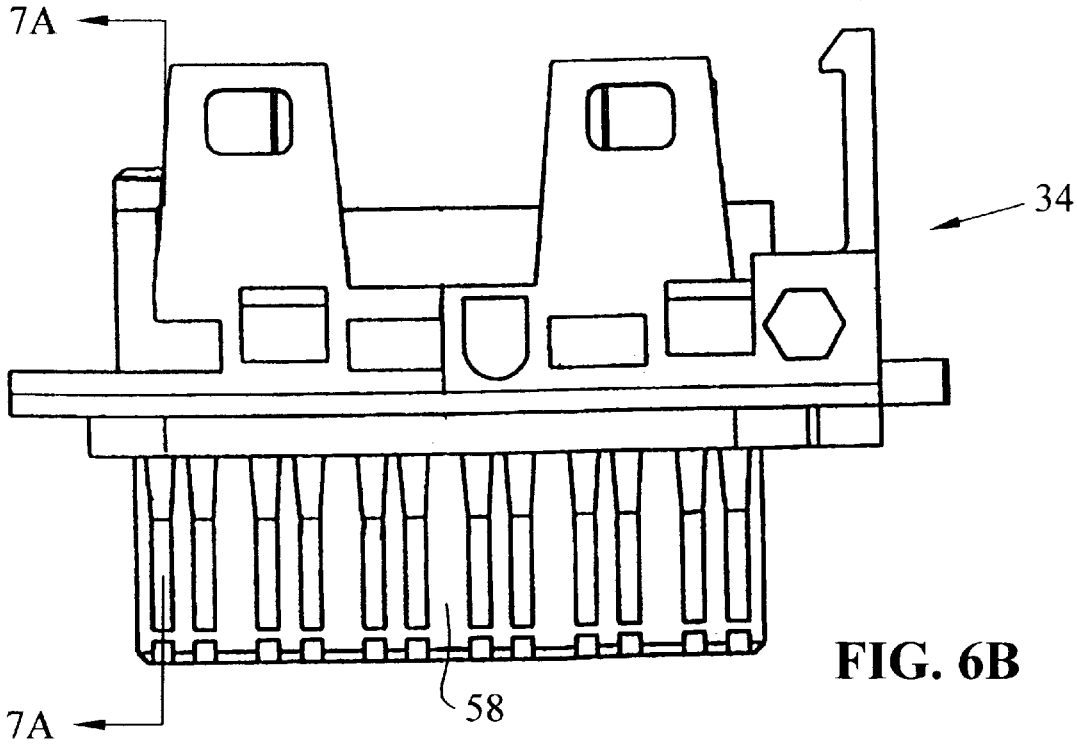
FIG. 6B shows a plan view similar to that of FIG. 6A showing the opposite side.

With reference now to FIGS. 6A and 7A, the assembly of the two stacked housings comprised of housings 34 and 38 will be described. As shown in FIG. 6A, the centerline CA between the alignment post 72 and the alignment opening 74 is offset by a distance O, from the centerline of the terminals CT. Thus, when the two hermaphroditic housings 34 and 38 are assembled by positioning respective alignment posts in respective alignment openings, the two cantilevered portions 54 are laterally staggered at the front face of the connector, as best shown in FIG. 1.

With the housing comprised of housing portions 34 and 38 assembled as described above, the shielding shroud 12 can now be slidably received over the front portion thereof until the latching openings 164 latch with respective latch projections 66 (FIG. 3) on housing 34, and a respective latching projection (not shown) on housing 38. This latches the combination of the housing portions 34 and 38 to the shielding shroud 12. The shielding shroud can then be placed in the shielded portion 32 such that the side edges of the front wall portion 160 of the shielding shroud 12 are received in slots 210 and 212 of a corresponding shielding shell 32.

The jackbolts 16 and 18 are thereafter positioned in their respective positions, such that jackscrew 16 is positioned through a corresponding opening 224 and on platforms 240, 244, and jackscrew 18 is positioned on corresponding platforms 248, 252. The top portion 30 can thereafter be positioned above shielding shell 32 and threaded fasteners can be positioned through openings 270, 272, 274 (FIG. 2) to fasten the two shielding shells together. It should be appreciated that the cable 6 is dressed through the opening 204 and, in the preferred embodiment, would include a strain relief collar.

It should also be understood that the housings 34, 38 together with the shielding shells provide a locking feature for the terminals. That is, the inside dimensions between the walls 200, traps the housings together, as well as preventing enough clearance for the latch arms 82 to come unlatched. This provides enhanced pull out strength for the terminals.

To connect the two connectors 2, 4 together, it should be appreciated that the shroud portion 14 of the receptacle 4 is inserted within shroud portion 12 of the plug 2. It should be appreciated that, from the profile of the shroud for each of the plug and receptacle are mirror images of each other such that, when the two connectors are mated, the concave radiused portions correspond in overlapping relation. It should also be appreciated that this places the jackscrews 16, 18 in alignment with the threaded inserts 20 and 22 to pull the two connectors into complete engagement.

Advantageously, the plug design as described above provides a high-density design, capable of accomplishing the requirements set out. Thus, the two stacking connector housings 34, 38 allow individual wires to be soldered to their respective portions. Without the separate housings 34, 38, it would be difficult to access the inner wire connecting portions for soldering. Other types of wire connecting portions, such as crimp or insulation displacement styles, would not allow the small centerline spacing between the terminals. In the preferred embodiment of the invention, the centerline spacing between contact portions 140A, 140B in the same twisted pair combination is 1.0 mm; and the centerline spacing between adjacent contact portions between pairs is 1.5 mm. Thus, given the close centerline spacing and provision of a multiple of rows, the high-density nature of this plug connector is realized.

What we claim is:

1. An electrical connector, comprising:

an insulative housing body assembly comprised of two bi-partite housing portions, each housing portion including first and second rows of terminal receiving cavities, a first row adjacent to a first major surface of each said housing portion, and a second row adjacent to a second major surface of each housing portion, the two housing portions being adaptable for stacking together with the second major surface of each said housing portion proximate; and a plurality of electrical terminals, each said terminal including a front contact portion, an intermediate body section, and a rear wire connecting section, each said rear wire connecting section comprising a blade section adapted to receive a wire in soldered connection, said rear wire connecting portions being adapted for connecting pairs of twisted pair cables, with blade sections for a twisted pair having a centerline spacing which is less than, adjacent blade sections for adjacent pairs.

2. The electrical connector of claim 1, wherein said housing portions are hermaphroditic.

3. The electrical connector of claim 2, wherein the housing portions include an upstanding alignment post on one side of said second major surface, and a corresponding alignment aperture on a laterally disposed side, whereby when said hermaphroditic housing portions are stacked one above the other, corresponding alignment posts and apertures assure proper alignment.

4. The electrical connector of claim 3, wherein the lateral centerline of the terminal receiving cavities is offset from the centerline between the alignment post and alignment aperture.

5. The electrical connector of claim 1, wherein the terminal receiving cavities are comprised of a front open channel to receive the front contact portions, and a rear open portion allowing access to the rear wire connecting sections.

6. The electrical connector of claim 5, wherein each housing portion is comprised of front and rear sections, the front section including the front open channels, and the rear section includes the rear open portions.

7. The electrical connector of claim 6, wherein the terminal receiving cavities further comprise intermediate cavity portions for retaining the terminals.

8. The electrical connector of claim 7, wherein the front and rear housing sections include latching mechanisms to retain the two members together.

9. The electrical connector of claim 8, further comprising an outer shielding shell enclosing the housing body assembly.

10. The electrical connector of claim 9, wherein the outer shielding shell is profiled to back up the latching mechanisms preventing the latching mechanisms from coming unlatched.

11. The electrical connector of claim 1, wherein the rear wire connecting sections of the terminals include an L-shaped conductive member, comprised of the flat blade section and a wall section extending from a side edge thereof.

12. The electrical connector of claim 11, wherein said housing portions include wire alignment recesses positioned forward of said rear wire connecting sections, whereby wire ends may be inserted into the wire alignment recesses, assuring alignment over the wire connecting sections.

13. The electrical connector of claim 11, wherein the connector is arranged for connection to twisted pair cable, with side-by-side terminals in the same row being adapted for connection to a twisted pair of conductors, the terminals being arranged with the L-shaped sections back-to-back with a thin web of material between them to minimize the centerline spacing between pairs.

14. An electrical connector, comprising:

an insulative housing body having at least two cantilevered housing portions extending from a main body portion, said cantilevered housing portions being positioned vertically above one another in a laterally offset manner, with a side edge of each housing overextending a side edge of the other housing, each said cantilevered housing portion including first and second rows of terminal receiving cavities, a first row adjacent to an outside surface of each said housing section, and a second row adjacent to an inside surface of each housing portion; and a plurality of electrical terminals, each said terminal including a front contact portion, an intermediate body section, and a rear wire connecting section.

15. The electrical connector of claim 14, wherein said rear wire connecting section comprises a blade section adapted to receive a wire in soldered connection.

16. The electrical connector of claim 15, wherein the rear wire connecting sections of the terminals include an L-shaped conductive member, comprised of the flat blade section and an integral wall section extending from a side edge thereof.

17. The electrical connector of claim 16, wherein said housing portions include wire alignment recesses positioned forward of said rear wire connecting sections, whereby wire ends may be inserted into the wire alignment recesses, assuring alignment over the wire connecting sections.

18. The electrical connector of claim 16, wherein the connector is arranged for connection to twisted pair cable, with side-by-side terminals in the same row being adapted for connection to a twisted pair of conductors, the terminals being arranged with the L-shaped sections back-to-back with a thin web of material between them to minimize the centerline spacing between pairs.

19. The electrical connector of claim 14, wherein said insulative housing body is comprised of two housing portions, each housing portion having a cantilevered housing section.

20. The electrical connector of claim 19, wherein said housing portions are hermaphroditic.

21. The electrical connector of claim 20, wherein the housing portions include an upstanding alignment post on one side of said second major surface, and a corresponding alignment aperture on a laterally disposed side, whereby when said hermaphroditic housing portions are stacked one above the other, corresponding alignment posts and apertures assure proper lateral offset alignment.

22. The electrical connector of claim 14, wherein the terminal receiving cavities are comprised of a front open channel to receive the front contact portions, and a rear open portion allowing access to the rear wire connecting sections.

23. The electrical connector of claim 22, wherein each housing portion is comprised of front and rear sections, the front section including the front open channels, and the rear section includes the rear open portions.

24. The electrical connector of claim 23, wherein the terminal receiving cavities further comprise intermediate cavity portions for retaining the terminals.

25. An electrical connector, comprising:

an insulative housing body assembly comprised of two bi-partite housing portions, each housing portion including first and second rows of terminal receiving cavities, a first row adjacent to a first major surface of each said housing portion, and a second row adjacent to a second major surface of each housing portion, the two housing portions being adaptable for stacking together with the second major surface of each said housing portion proximate, said cavities including rear open channels; and a plurality of electrical terminals, each said terminal including a front contact portion, an intermediate body section, and a rear wire connecting section, said rear wire connecting section comprising L-shaped wire receiving sections for receiving a wire in soldered connection, said L-shaped wire connecting portions being adapted for back-to-back positioning in said channels for connection to pairs of twisted pair cables.

26. The electrical connector of claim 25, wherein said housing portions include wire alignment recesses positioned forward of said rear wire connecting sections, whereby wire ends may be inserted into the wire alignment recesses, assuring alignment over the L-shaped wire connecting sections.

27. The electrical connector of claim 25, wherein the connector is arranged for connection to twisted pair cable, with side-by-side terminals in the same row being adapted for connection to a twisted pair of conductors, the being arranged with the back-to-back L-shaped terminals sections having a thin web of material between them to minimize the centerline spacing between pairs.

28. The electrical connector of claim 27, wherein the lateral centerline of the terminal receiving cavities is offset from the centerline between the alignment post and alignment aperture.

29. The electrical connector of claim 25, wherein said connector portions are hermaphroditic.

30. The electrical connector of claim 29, wherein the housing portions include an upstanding alignment post on one side of said second major surface, and a corresponding alignment aperture on a laterally disposed side, whereby when said hermaphroditic housing portions are stacked one above the other, corresponding alignment posts and apertures assure proper alignment.

31. An electrical connector, comprising:

an insulative housing body assembly comprised of two bi-partite housing portions, each housing portion including first and second rows of terminal receiving cavities, a first row adjacent to a first major surface of each said housing portion, and a second row adjacent to a second major surface of each housing portion, the two housing portions being adaptable for stacking together with the second major surface of each said housing portion proximate, said cavities including first and second rear open channels, with said first open channel facing said first major surface, and said second open channel facing said second major surface; and a plurality of electrical terminals, each said terminal including a front contact portion, an intermediate body section, and a rear wire connecting section positioned accessible through said first and second open channels, with said rear wire connecting section being adapted for connection to a wire in soldered connection.

32. The electrical connector of claim 31, wherein said housing portions include wire alignment recesses positioned forward of said rear wire connecting sections, whereby wire ends may be inserted into the wire alignment recesses, assuring alignment over the wire connecting sections.

33. The electrical connector of claim 31, wherein each said rear wire connecting section comprising a blade section adapted to receive a wire in soldered connection, said rear wire connecting portions being adapted for connecting pairs of twisted pair cables, with blade sections for a twisted pair having a centerline spacing which is less than, adjacent blade sections for adjacent pairs.

34. The electrical connector of claim 33, wherein the wire connecting portions are L-shaped terminals sections positioned in a back-to-back relation having a thin web of material between them to minimize the centerline spacing between pairs.

35. The electrical connector of claim 31, wherein the lateral centerline of the terminal receiving cavities is offset from the centerline between the alignment post and alignment aperture.

36. The electrical connector of claim 35, wherein said connector portions are hermaphroditic.

* * * * *